United States Patent [19]

Huzyak

[11] 4,418,559

[45] Dec. 6, 1983

[54] ROLL COOLANT DISTRIBUTION HEADER

[75] Inventor: Paul E. Huzyak, Salem, Ohio

[73] Assignee: Gulf & Western Manufacturing Co., Southfield, Mich.

[21] Appl. No.: 328,555

[22] Filed: Dec. 8, 1981

[51] Int. Cl.[3] ..... B21B 45/02

[52] U.S. Cl. ..... 72/201; 72/236; 239/550

[58] Field of Search ..... 239/550, 551; 72/201, 72/236

[56] References Cited

U.S. PATENT DOCUMENTS 2,811,059 10/1957 Appleby ..... 72/201
3,289,449 12/1966 O'Brien ..... 72/201
3,646,790 3/1972 Properzi ..... 72/201
4,247,047 1/1981 Schaming ..... 72/201

*Primary Examiner*—W. D. Bray

[57] ABSTRACT

A roll coolant distribution header is provided. The header includes a binary valve assembly comprising a plurality of individually mounted two-stage solenoid valves. The valves extend through a plenum chamber filled with coolant. Spray nozzles project through one side of the chamber. The solenoids extend through the opposite side of the chamber and are sealed therefrom. Coolant is introduced into the chamber through its hollow trunnions from mounting/distributor blocks. The mounting/distributor blocks are fitted with coolant pipe connections.

16 Claims, 6 Drawing Figures

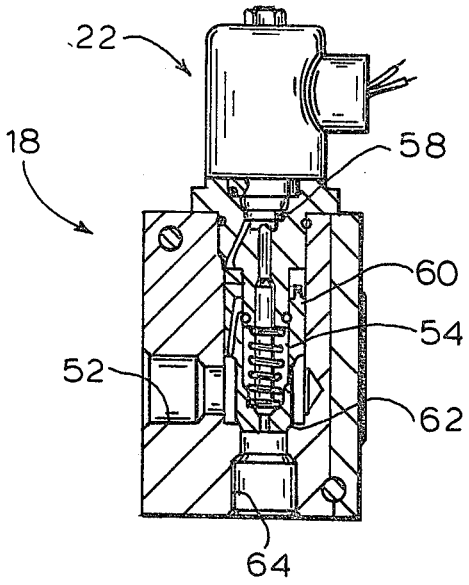
FIG.5
FIG.5A
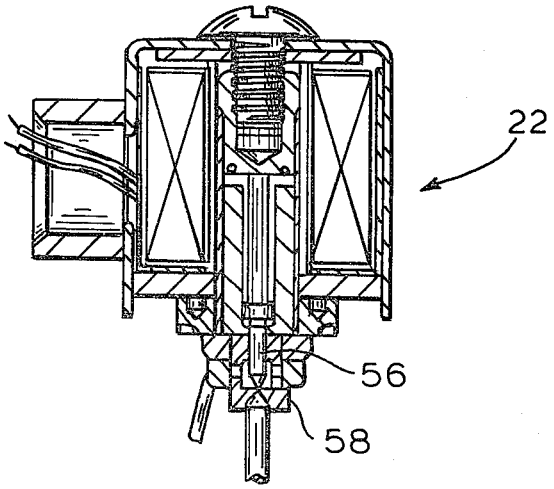

ROLL COOLANT DISTRIBUTION HEADER

BACKGROUND OF THE INVENTION

1. Field of the invention.

The field of the invention relates to header assemblies for spraying press rolls during the manufacture of sheet metal.

2. Brief description of the prior art.

The cold rolling of sheet stock is accomplished by passing metal strip through at least one press nip defined by a pair of rolls. The strip is subjected to varying degrees of reduction at right angles to the direction of rolling. If excess work is performed at the center of the stock, the center elongates longitudinally more than the edges and may buckle in the center. If excess work is performed at the edges, the converse is true.

Many factors, such as quality of input stock, localized heating of the mill roll faces, or deflection of the rolls, influence these cold work variations. Since the strip is reduced not only by roll compression but also by the high tensile loads applied with the coiler, these defective areas are difficult to detect until the coil is complete. The defects that are detected during rolling are compensated for through manual adjustment of the rolling mill or through the application of coolant to the roll faces. It is important that these defects be substantially reduced, if not eliminated entirely because those areas of the sheet stock outside the acceptable flatness limits must be scrapped with resulting economic loss.

Shape sensing rolls have been developed to monitor the rolling mill output. One method of adjusting the mill to level out the force differentials has been to control the temperature of the rolls by the selective spraying of coolant. This is used in combination with a technique known as roll bending in order to arrive at the desired sheet profile.

Signals from a shape sensing roll cause the automatic adjustment of each coolant spray section to reduce uneven temperature distribution. The relative positions of the rolls may also be adjusted.

State of the art roll coolant distribution headers incorporate a series of equally spaced, electrically operated valves which are arranged so as to be able to distribute the roll coolant evenly over the faces of the rolls. The valves are designed to permit variation from uniformity of the coolant distribution on the roll faces by remote manual or automatic means. The coolant can therefore be applied so as to permit thermal crowning of the rolls toward the end goal of producing a transversely flat strip.

Roll coolant valves have traditionally been of two types. The first type includes proportional valves in which the coolant flow through the valve is approximately proportional to the voltage applied thereto. Some of these are without feedback loops and therefore are not reliably accurate. Others are equipped with feedback loops and are much more accurate, but this improvement in accuracy of flow control is accompanied by an increase in valve size, sensitivity to damage, and cost of manufacture.

A second type of roll coolant valve which has been successfully empolyed is the binary valve which comprises two or more individual on-off valves. Flow control is accomplished by having the valves sized to pass coolant at rates which are different by successive multiples of two (2). That is, 1 gpm, 2 gpm, 4 gpm, 8 gpm, etc. For example, if only two (2) valves are used, the coolant flow can be adjusted in increments of one-third of the maximum flow. That is, proper energization of the valves can provide one (1) unit of flow, two (2) units of flow, or three (3) units of flow. If three individual valves are used, the coolant can be adjusted in increments of one-seventh of the maximum flow. If four (4) individual valves are used, the increment is one-fifteenth of the maximum flow, etc. The binary valves sacrifice infinitely variable flow control for simplicty and reliability of operation with no appreciable loss in control of the transverse flatness of the strip.

State of the art flow header designs incorporate binary type valve systems. The individual valves have been integrated into one single unit which installs directly into the coolant plenum chamber. Single-stage solenoid-operated valves are utilized. The plenum chamber is fitted with pipe connections for the coolant supply lines. The spray nozzles which are supplied by the individual valves are gang-mounted in a retainer plate fastened to the plenum chamber by means of screws.

Divadvantages of the above-described system include:

1. Electrical control wiring to the individual valves must pass through areas which are completely enveloped by roll coolant. In the event of sealing device failure, coolant leakage can short the control wiring to ground causing loss of operation and/or electrical failures;

2. The single-stage valves require a relatively large electrical current to remain open against the valve spring closing force. This current requires relatively large wires and generates heat in the solenoid necessitating the solenoid being immersed in the coolant of the plenum chamber. This current also requires a relatively large power supply/controller;

3. Maintenance of any individual valve requires the removal of the entire gang of nozzles;

4. Maintenance of any individual nozzle requires the removal of an entire gang of nozzles and the complete binary valve;

5. Maintenance of the entire header, or the plenum alone, requires the removal of the feed pipes from the plenum.

SUMMARY OF INVENTION

A roll coolant distribution header is provided by the invention for reliably and economically supplying coolant to the face portion of a roll.

The valves utilized in accordance with the invention are two-stage valves. Such valves have been employed in various applications, but it has previously been thought that the coolant used in rolling mill operations would be too dirty to allow their reliable operation. It has been found, however, that two-stage valves may successfully be employed in this field with most adequate reliability and resultant savings in cost of power. Typical roll coolants include kerosene, fuel oil, and/or mineral seal oil plus additives. In certain uses, aluminum oxides become suspended within the coolant. It has been found that these oxides or other sediments will not settle out within the valve components to affect this operation during the normal life of the valve.

The coolant distribution header is characterized in that no electrical wiring passes through any coolant enveloped area. All wiring is confined to an enclosed, sealed cavity outside and on the back side of the coolant plenum chamber.

The spray nozzles used in accordance with the invention are individually bayonet mounted in the individual valves without the use of separate fastening devices. The coolant plenum chamber is not fitted with pipe connections but is instead supplied with coolant through hollow trunnions from mounting/distributor blocks. These mounting/distributor blocks are fitted with coolant pipe connections.

BRIEF DESCRIPTION OF THE DRAWINGS

FIG. 5 is a sectional elevation view of a standard two-stage valve utilized in accordance with the invention;

FIG. 5A is a sectional view illustrating the top portion of the valve shown in FIG. 5.

DETAILED DESCRIPTION OF THE INVENTION

Figure 1:
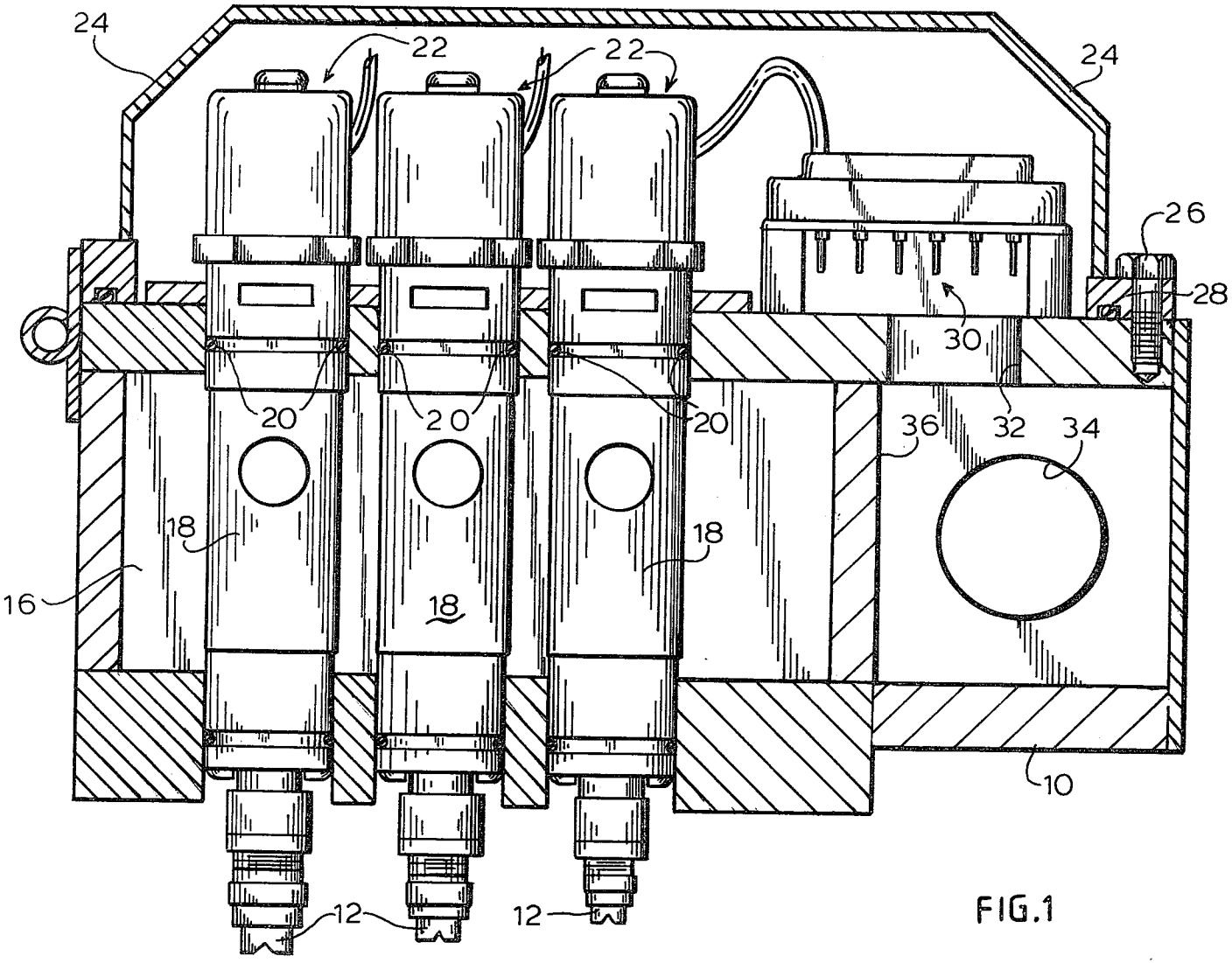
FIG. 1 is a sectional elevation view of header assembly according to the invention.
Figure 2:
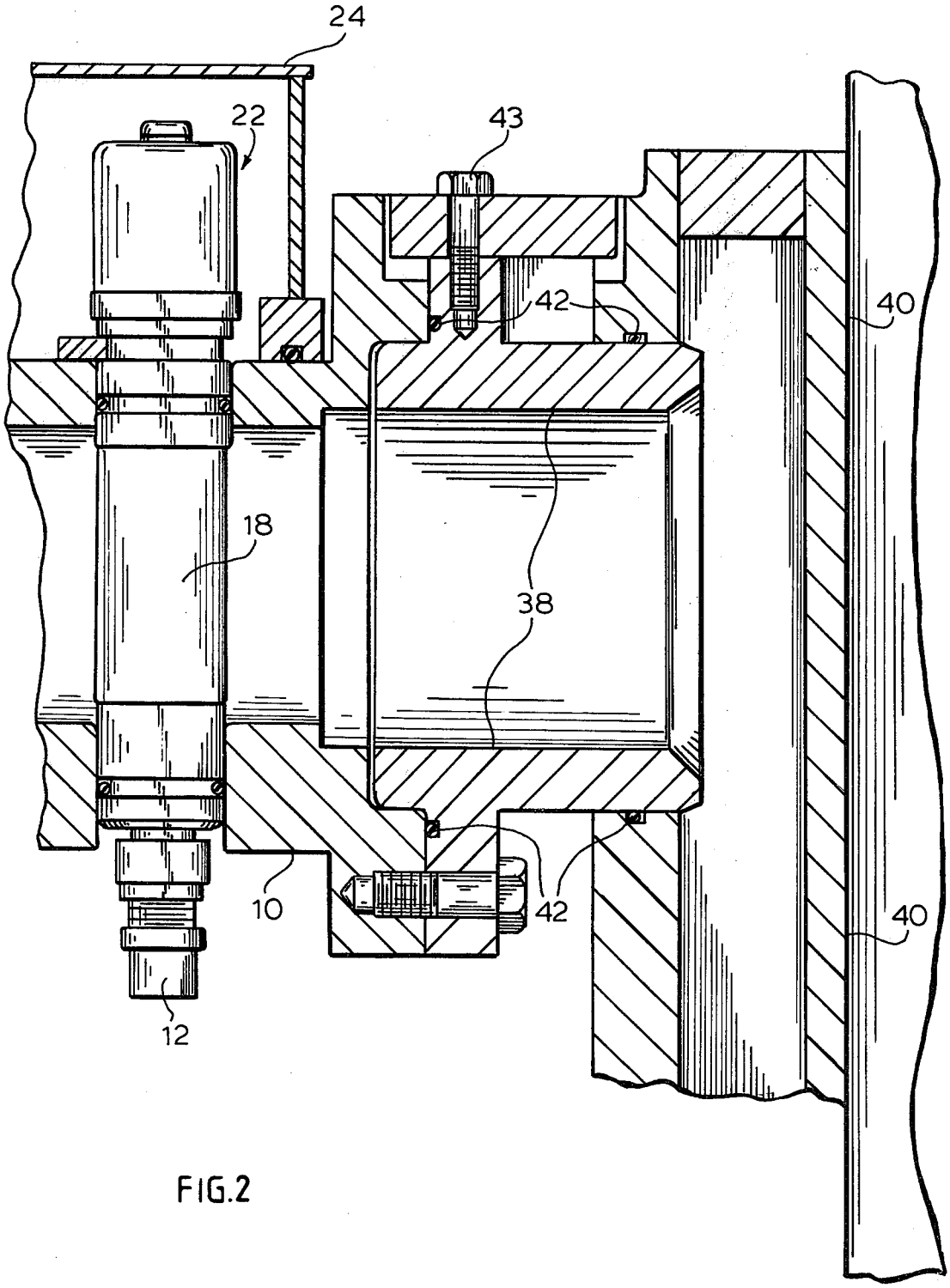
FIG. 2 is a sectional front view of a portion of the header assembly shown in FIG. 1.
Figure 3:
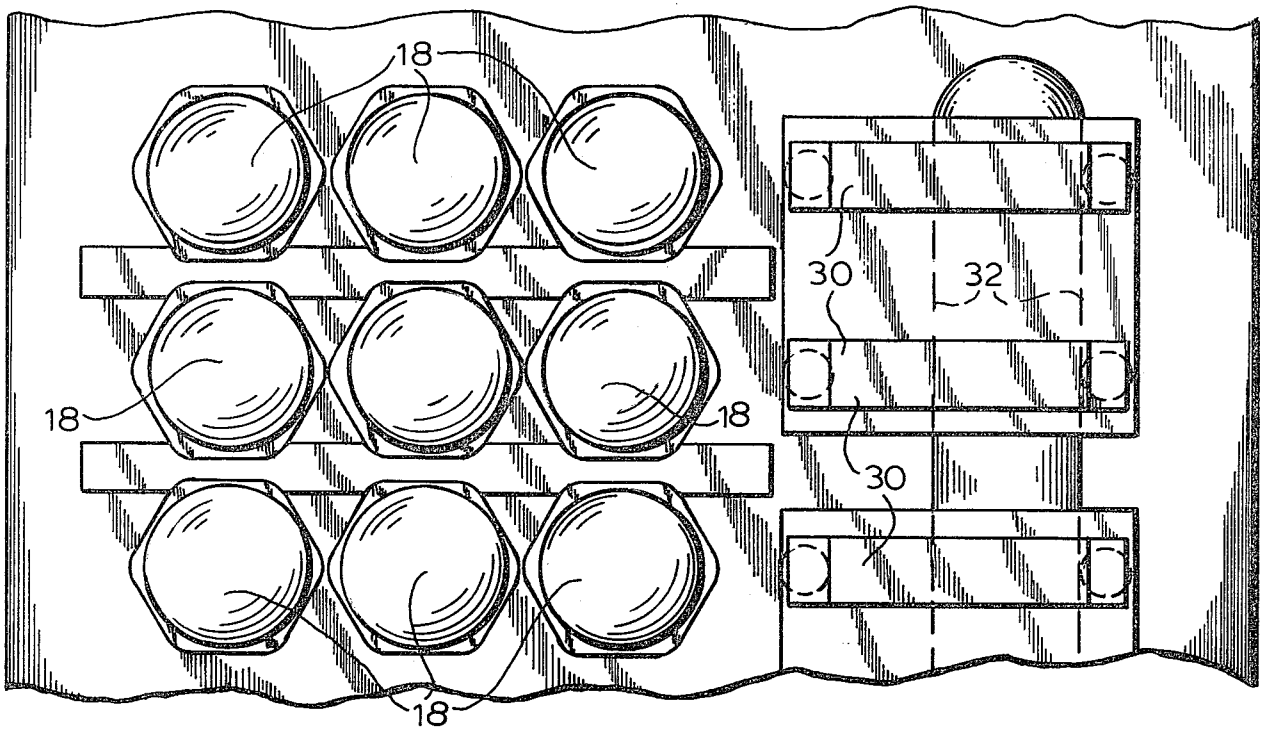
FIG. 3 is a top view of a portion of the header assembly shown in FIG. 1.

A roll coolant header 10 including a plurality of spray nozzles 12 for selectively spraying a roll 14 is shown in FIGS. 1–3. The header 10 includes a plenum chamber 16 within which a plurality of two-stage valves 18 are positioned, one valve for each spray nozzle. As shown in FIG. 1, the spray nozzles are of varying sizes and together with the valves comprise a binary valve assembly. The required flow of coolant may be sprayed by activating the appropriate number of valves by either manual or automatic means.

The valves 18 are individually mounted within the plenum chamber 16. O-rings 20 seal the valve housing against the chamber walls. Each valve includes a solenoid assembly 22 for initial actuation. The solenoid assemblies and the wires leading thereto are located outside the plenum chamber and accordingly will not come in contact with any coolant. A cover 24 is sealingly attached to the header 10 by means of screws 26 and gasket 28. The solenoid assemblies 22 are positioned in the chamber defined by the header 10 and cover 24 as are the electrical connectors 30 for the wires.

An opening 32 is provided within the header walls through which the wires extend to a wire conduit 34. This portion of the header 10 is separated from the plenum chamber 16 by a dividing wall 36. The wires or cables from the electrical connectors proceed to a control system (not shown) for actuating the valves.

The header 10 is secured to a flange retainer 38 which is in turn secured to a mounting bracket/cooling inlet 40. Gaskets 42 are provided where necessary to insure fluid-tightness. By removing key 43 which is shown bolted to the flange retainer 38 in FIG. 2, the header 10 and flange retainer 38 may be angularly adjusted with respect to the mounting bracket 40. The rotatability of the header 10 allows the nozzles 12 to be aimed at the desired portions of the rolls.

A plurality of keyways (not shown) within header 10, flange retainer 38, and mounting bracket 40 are arranged in vernier fashion to allow the accurate adjustment of the header. A first set of keyways are aligned with respect to the header and flange retainer while a second set are aligned with respect to the flange retainer and mounting bracket. Keys positioned within the keyways provide a positive locking mechanism for the respective elements. Fine increments of adjustment and positive locking of the header 10 with respect to the mounting bracket 40 are possible in this manner.

Figure 4:
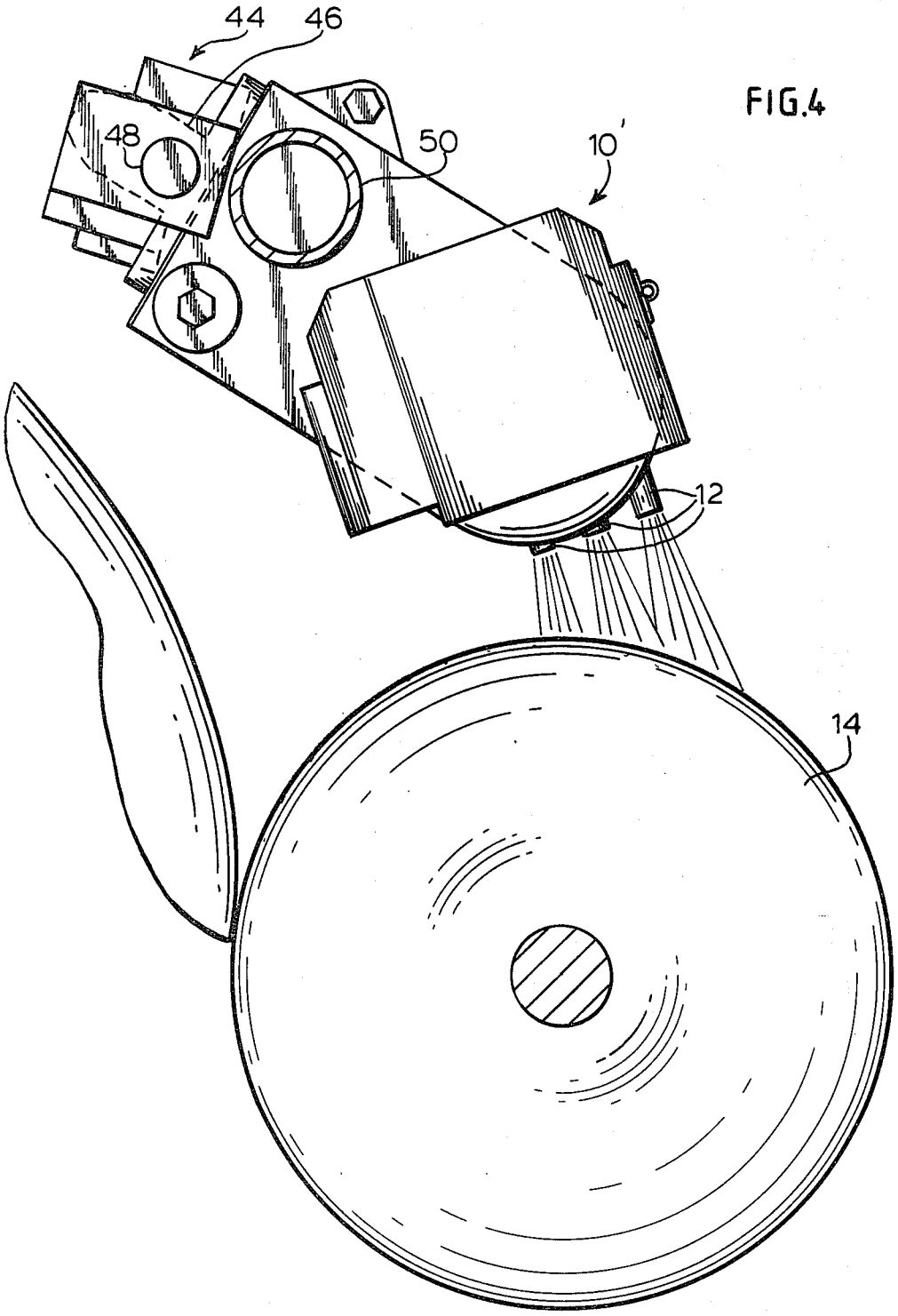
FIG. 4 is a schematic view of an auxiliary header assembly as employed in a rolling mill.

FIG. 4 schematically illustrates an auxiliary header 10' and a mounting assembly 44 therefor. A pivotable member 46 is secured to the mounting assembly allowing it to pivot about the axis of shaft 48. A fluid inlet pipe 50 enters the mounting assembly and is in fluid communication with header plenum chamber. Although the mounting assembly for the auxiliary header 10' is different, the header 10' is otherwise similar in construction to the main header 10 described above.

Two-stage valves 18 are employed in conjunction with the invention and provide significant savings in energy requirements. Single-stage valves used to perform similar functions required about one amp to remain open. By taking advantage of the coolant pressure, which may be about one hundred pounds per square inch, the energy requirements are substantially reduced to about one third of an amp by using a two-stage valve. Suprisingly, it has been found that the coolant does not tend to damage the valve during its normal working life.

A number of conventional two-stage valves would be suitable for the purposes intended herein. FIGS. 5 and 5A illustrate a conventional valve which has been successfully employed.

The valve 18 includes an inlet 52 which allows coolant to enter from the plenum chamber. A spring 54 normally maintains the valve in the closed position. The pressure of the coolant also contributes towards holding the valve in this position.

The solenoid assembly 22 may be actuated for lifting a poppet 56 from a pilot seat 58. Soon after the pilot flow is established, the spring force is overcome allowing a piston 60 to rise from its seat 62. The main coolant flow from inlet 52 to outlet 64 may then occur. The pressure of the coolant urges the valve to maintain the open position.

In operation, a sensing device is provided downstream from the press rolls 14 to detect irregularities in the finished product. Upon sensing such irregularities, instructions are sent to the headers to cause the actuation of one or more the valves comprising the binary valve assemblies therein. The rolls 14 are then sprayed by the nozzles with the required amount of coolant. There is virtually no danger of an electrical short as the solenoid assemblies 22, wiring, electrical connectors 30, and wire way 32 are all isolated from the coolant plenum chamber. Because two-stage valves are employed, less current is used and less heat is generated. This eliminates the need to immerse the solenoid within the coolant and risk potential shorting. The wet armature design of the solenoid has been found to be more than adequate for heat removal.

The plenum chamber is supplied with coolant from piping which is connected to the mounting assembly. No pipes are connected to the chamber itself. Maintenance of the header accordingly does not require the removal of feed pipes. The absence of the pipes also allows the header to be adjusted more easily on its rotatable trunnion mountings.

The wiring within the header is accessible by simply removing the cover. Removal of the valves is unnecessary.

The nozzles may be removed individually. By changing only the nozzle, any individual valve may replace any other individual valve. This interchangeability greatly reduces the number of parts required to produce binary valves or various different flow increments. The individual valves may also be removed separately, with or without its nozzle and without the electrical disconnection of the entire binary valve assembly.

What is claimed is:

1. A roll coolant distribution assembly comprising:

a header;

a chamber defined within said header;

a plurality of two-stage valves mounted to said header, portions of said valves being positioned within said chamber;

each of said valves including an inlet, an outlet, and means for controlling the passage of coolant from said inlet to said outlet, said inlet positioned within said chamber;

a plurality of nozzles extending from said chamber, said valve outlets each being connected to one of said nozzles;

said valves each including a solenoid for actuating said controlling means, said solenoids being positioned outside the header and sealed from said chamber; and a cover secured to said header, said cover and said header defining an enclosure for said solenoids.

2. An assembly as defined in claim 1 including a mounting assembly to which said header is secured, said mounting assembly including a fluid inlet and means connecting said fluid inlet to said chamber.

3. As assembly as defined in claims 1 or 2 including a roll coolant within said chamber.

4. An assembly as defined in claims 1 or 2 wherein each of said valves are individually mounted to said header and each of said nozzles are individually connected to a respective one of said valve outlets.

5. An assembly as defined in claims 1 or 2 including an electrical connector assembly and wires leading thereto from said solenoids, said electrical connector assembly and said wires both being positioned within said enclosure defined by said header and said cover.

6. An assembly as defined in claim 5 wherein said header includes a closed chamber receiving wires from said electrical connector assembly, an opening within a wall of said header connecting said enclosure with said closed chamber, and means separating said first-mentioned chamber from said closed chamber.

7. An assembly as defined in claims 1 or 2 wherein said plurality of valves comprise a binary valve assembly.

8. An assembly as defined in claim 2 including a retaining assembly rotatably mounted to said mounting assembly, said header being rotatably mounted to said retaining assembly.

9. An apparatus for the rolling of sheet stock, comprising:

a plurality of rolls positioned with respect to one another for the rolling of sheet stock;

a coolant distribution header positioned adjacent to said rolls;

a chamber defined within said header;

a plurality of valves mounted to said header, each of said valves including an inlet, an outlet, and means for controlling the passage of coolant from said inlet to said outlet, said inlets being positioned within said chamber;

a plurality of nozzles extending from said chamber and aimed towards at least one of said rolls, said valve outlets each being connected to one of said nozzles;

portions of said valves extending outside said header and sealed from said chamber, said portions including electrical actuating means for actuating said controlling means;

a cover secured to said header defining on enclosure in which said valve portions are positioned; and means for supplying said chamber with pressurized coolant.

10. An apparatus as defined in claim 9 including a mounting assembly, said header being attached to said mounting assembly, said mounting assembly including a fluid inlet and means connecting said fluid inlet to said chamber.

11. An apparatus as defined in claim 9 or 10 wherein said valves are two-stage valves.

12. An apparatus as defined in claims 9 or 10 wherein each of said valves are individually mounted to said header and each of said nozzles are individually connected to said valve outlets.

13. An apparatus as defined in claim 11 wherein said electrical actuating means for said valves are solenoids.

14. An apparatus as defined in claim 13 including an electrical connector assembly and wires leading thereto from said solenoids positioned within said enclosure defined by said header and said cover.

15. An apparatus as defined in claims 9 or 10 wherein said plurality of valves comprise a binary valve assembly.

16. An apparatus as defined in claim 10 including a retaining assembly rotatably mounted to said mounting assembly, said coolant distribution header being rotatably mounted to said retaining assembly.

* * * * *